US005636182A

United States Patent [19]

Suzuki et al.

[11] Patent Number: 5,636,182

[45] Date of Patent: Jun. 3, 1997

[54] PORTABLE ULTRASONIC UNDERWATER SENSOR

[75] Inventors: Hideyuki Suzuki; Kimihiko Yazawa; Yasuhiro Sakamoto, all of Shizuoka, Japan

[73] Assignee: Fuji Ultrasonic Engineering Co., Ltd., Harmamatsu, Japan

[21] Appl. No.: 587,957

[22] Filed: Jan. 17, 1996

[30] Foreign Application Priority Data

Jan. 18, 1995 [JP] Japan ..... 7-022323

[51] Int. Cl.[6] ..... H04R 17/00

[52] U.S. Cl. ..... 367/165; 367/141; 310/337

[58] Field of Search ..... 367/141, 152, 367/157, 162, 165, 173, 176; 310/321, 322, 323, 324, 337, 348

[56] References Cited

U.S. PATENT DOCUMENTS

| | | | |
|---|---|---|---|
| 3,736,632 | 6/1973 | Barrow | 310/312 |
| 3,943,388 | 3/1976 | Massa | 310/324 X |
| 4,220,040 | 9/1980 | Noguchi et al. | 73/24 |
| 4,755,975 | 7/1988 | Ito et al. | 367/140 |
| 4,823,042 | 4/1989 | Coffey et al. | 310/322 |

FOREIGN PATENT DOCUMENTS

| | | | |
|---|---|---|---|
| 0173999 | 9/1985 | Japan | 310/324 |

OTHER PUBLICATIONS

Japanese Unexamined Patent Publication (JP–A) No. Hei 3(1991)–68226 (Taiheiyo Asutei K.K.) Dated: 1991.

Japanese Examined Patent Publication No. Sho 61(1986)–13172 (Untranslated name in Japanese language) Dated: 1986.

*Primary Examiner*—Ian J. Lobo

*Attorney, Agent, or Firm*—Dvorak and Traub

[57] ABSTRACT

A portable ultrasonic underwater sensor 15 has a piezoelectric element 21 disposed in a case 22 constructed as a cylinder 24 and having a truncated cone 25 both being integrally and axisymmetrically formed so as to constitute a vibrator 22A. A piezoelectric element 21 and the vibrator 22A are bonded together with a center of the piezoelectric element 21 matches the center of a reverse face of the truncated cone 25 of vibrator 22A, whereby the vibrator 22A is entirely resonant in a vibration mode in which flexional vibration at the center of the truncated cone 25 is a maximum amplitude, and wherein means for holding the vibrator 22A is located along a vibration nodal line on an external side face of the vibrator 22A.

2 Claims, 4 Drawing Sheets

PORTABLE ULTRASONIC UNDERWATER SENSOR

BACKGROUND OF THE INVENTION

1. Field of the Invention

The present invention relates to a portable ultrasonic underwater sensor that can adequately function as an ultrasonic transmitter-receiver for communication between divers or between underwater bases.

2. Description of the Background Art

Conventional ultrasonic underwater sensors use (a) an ultrasonic underwater sensor of a thickness vibration mode wherein a face for transmitting and receiving a wave is provided in front of a columnar piezoelectric vibrator, and (b) an ultrasonic underwater sensor of a radial vibration mode wherein a face for transmitting and receiving a wave is provided that externally contacts a columnar piezoelectric vibrator using a center shaft in common.

A further description of the prior art will be discussed in detail later with reference to the drawings.

SUMMARY OF THE INVENTION

It is an object of the present invention to provide a portable ultrasonic underwater sensor that ensures high efficiency and is compact, light, and sturdy, and can be produced at a low cost.

The following functions (1) through (6) are provided in the present invention.

(1) Since the entire case of the piezoelectric element is constituted by an elastic element that is resonant in a flexional vibration mode, an ultrasonic resonance frequency (carrier frequency+frequency modulated by speech) can be tuned by adjusting the thickness, the diameter of the bottom face and the diameter of the top face of the truncated cone, and the height and the internal and external diameters of the cylinder, so that a compact and light design can be achieved.

(2) Since the piezoelectric element is formed as a thin plate, when compared with the thickness of the truncated cone, it is durable and is not damaged by impact when it is dropped or abused.

When the case is made of metal, such as SUS, or engineering plastic, it will not be deformed by impact when it is dropped or abused, and provides high degree protection for the piezoelectric element.

(3) Since the piezoelectric element is made of a thin and simple plate, the cost of production is low.

(4) Since the entire vibrator is resonant in the flexional vibration mode, the vibration of the cylinder can increase the vibration of the truncated cone (which has a face for transmitting and receiving a wave). The means for holding the vibrator supports a vibration node (a portion that is not vibrated) of the vibrator, and loss due to vibration friction does not occur at the supported portion. Therefore, the sensor functions at high efficiency and has a low power consumption.

(5) The shape of the vibrator is acquired by the finite element method, and the vibrator is actually produced to confirm that the optimal flexional vibration resonance mode is a mode in which the flexional vibration at the center of the truncated cone (its wave transmitting-receiving face), of the vibrator, is a maximum amplitude at the resonance frequency. At this time, the vibrator wherein the apex of the truncated cone is at 90 degree angle and wherein the truncated cone is as thick as the cylinder can be inferred from the flexional vibration of a disk. There are few variables, and the actually measured values match well the simulation by the finite element method, so that an ultrasonic underwater sensor with excellent sensitivity can be easily obtained.

(6) The reduction in wave reception sensitivity, which is caused by the damping capacitance of the vibrator with a thin plate piezoelectric element, can be prevented by connecting the NIC (Negative Immitance Converter) to the vibrator.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

Figure 8:
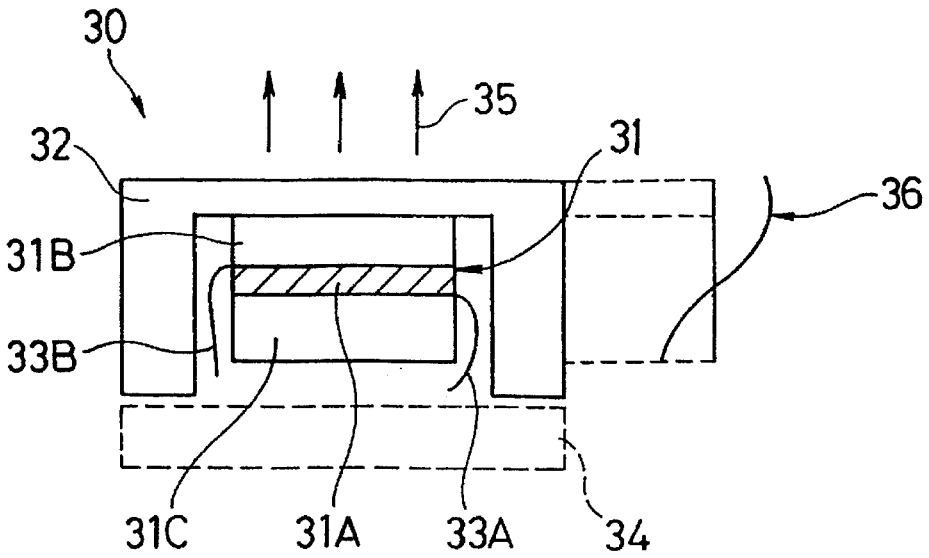
FIG. 8 PRIOR ART
FIG. 8 is a cross sectional view of a conventional ultrasonic underwater sensor of a thickness vibration mode.

DETAILED DESCRIPTION OF PRIOR ART STRUCTURE (Thickness vibration mode ultrasonic underwater sensor) (FIG. 8)

FIG. 8 is a cross sectional view of a conventional thickness vibration mode ultrasonic underwater sensor 30. The sensor 30 is so designed that a Langevin vibrator 31 of a thickness vibration mode is stored in a case 32. The Langevin vibrator 31 of a thickness vibration mode comprises a piezoelectric element 31A, a front unit 31B and a rear unit 31C. The case 32 includes an irradiation face for the vibrator 31, and is ordinarily formed of material (urethane rubber, etc.) that is well suited for fluid and the vibrator 31. Reference numbers 33A and 33B denote drive conductors for the vibrator 31, and 34 denotes a cover for tightly closing the case 32. An ultrasonic wave from the irradiation face of the case 32 is radiated in a direction indicated by arrows 35.

Reference number 36 is a longitudinal vibration mode of the vibrator 31. The vibrator 31 is so designed that its thickness corresponds to the longitudinal vibration mode 36, and its total thickness is equal to a half wavelength of a resonance frequency. The longitudinal resonance frequency is 33 KHz, the front unit 31B and the rear unit 31C are made with SUS316, and the total thickness of the vibrator 31 is about 80 mm.

Figure 9:
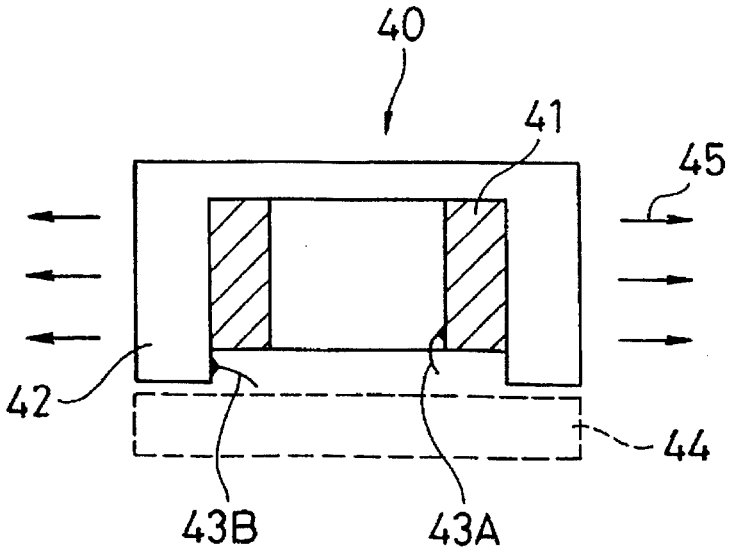
FIG. 9 PRIOR ART
FIG. 9 is a cross sectional view of a conventional ultrasonic underwater sensor of a radial vibration mode.

(Radial vibration mode ultrasonic underwater sensor) (FIG. 9)

FIG. 9 is a cross sectional view of a conventional ultrasonic underwater sensor 40 of a radial vibration mode. In the design of the ultrasonic underwater sensor 40 of a radial vibration mode, a cylindrical piezoelectric radial vibrator 41 is stored in a case 42. The case 42 includes an irradiation face for the vibrator 41, and, as well as in the case 32 of the thickness vibration ultrasonic underwater sensor 30, the case 42 is ordinarily formed of a material (urethane rubber, etc.) that is well suited for fluid and the vibrator 41. Reference numbers 43A and 43B denote conductors for driving the vibrator 41, and 44 denotes a cover for tightly closing the case 42. The vibrator 41 and the case 42 use the center axis in common. Since the vibrator 41 radially vibrates perpendicular to the center axis, an ultrasonic wave from the irradiation face is transmitted in a direction indicated by arrows 45.

The conventional thickness vibration mode ultrasonic underwater sensor 30, however, has the following problems, (1) and (2).

(1) The thickness vibration Langevin vibrator 31, as is described above, must have a thickness, for example, that reaches about 80 mm in order for it to match the half wavelength of a resonance frequency, and since the sensor is therefore thick and long, it is not very portable.

(2) Since the vibrator 31 is thick, the price of the sensor is high.

While the conventional radial vibration ultrasonic sensor 40 is compact, light and portable, it has the following problems, (1) and (2).

(1) Since the case 42 is formed of thin urethane rubber, etc., and thus is easily deformed by impact when it is dropped, etc., the case 42 cannot satisfactorily protect the vibrator 41 and will permit the vibrator 41 to be damaged by impact from physical abuse.

(2) The vibrator 41 has a cylindrical form and it is expensive.

An ultrasonic underwater sensor is desired that can provide high efficiency with reduced power consumption.

DESCRIPTION OF THE PREFERRED EMBODIMENT

Figure 2:
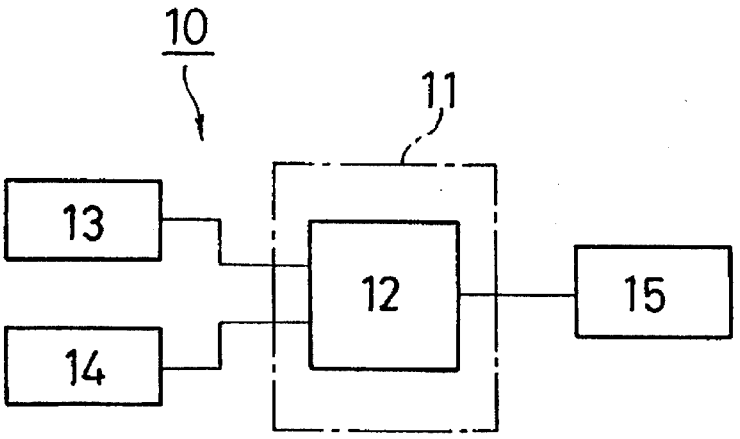
FIG. 2 is a block diagram illustrating an example of an underwater communication apparatus.

As is shown in FIG. 2, an ultrasonic underwater receiver 10 has an ultrasonic transmitting and receiving electric circuit 12 stored in a water pressure resistant case 11. A microphone 13, a loudspeaker, and an ultrasonic underwater sensor 15 (transmitter-receiver) are integrally formed with the case 11. An ultrasonic transmission/reception electric circuit 12 is known in the prior art as described for example, in Japanese Unexamined Patent Publication (JP-A) No. Hei 3-68226.

Figure 1:
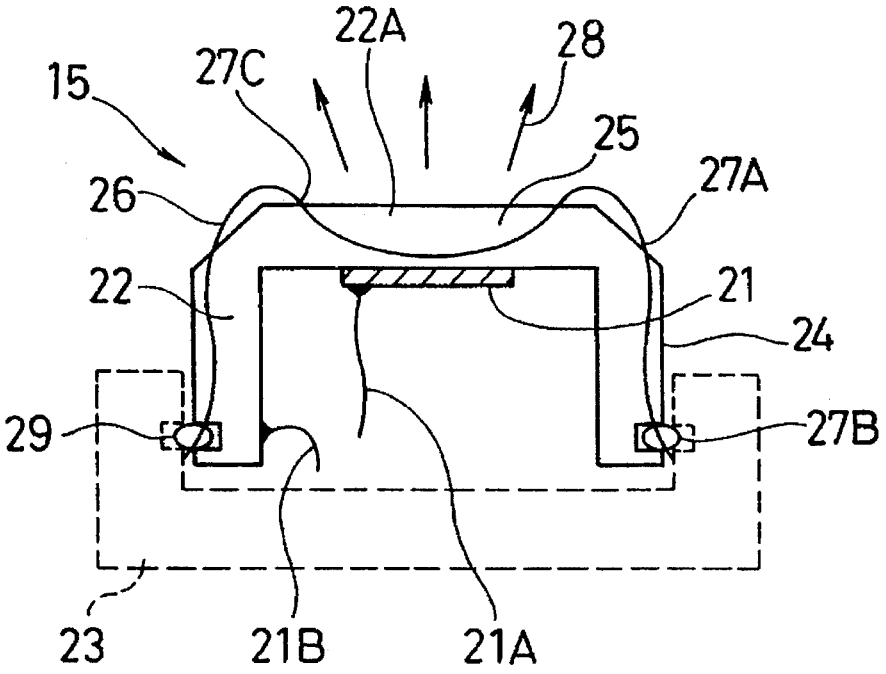
FIG. 1 is a cross sectional view of an example of a portable ultrasonic underwater sensor according to the present invention.

The ultrasonic underwater sensor 15 is formed by mounting a piezoelectric element 21 in a case 22, as is shown in FIG. 1. A cover 23 is employed for tightly closing the case 22. Conductors 21A and 21B are employed to drive the piezoelectric element 21.

The case 22 is an axisymmetrical formed cylinder 24 and a truncated cone 25, and this constitutes a vibrator 22A. The case 22 is made of metal, such as SUS, or plastic (engineering plastic).

The ultrasonic underwater sensor 15 is so designed that the center of the piezoelectric element 21 matches the center of the reverse face of the truncated cone 25 of the vibrator 22A. The piezoelectric element 21 and the vibrator 22A are bonded together, so that the entire vibrator 22A is resonantly vibrated in a vibration mode in which the flexional vibration at the center of the truncated cone 25 (the wave transmission and reception face) is of maximum amplitude. In FIG. 1, reference number 26 denotes an optimal flexional vibration resonance mode for the vibrator 22A; and 27A, 27B and 27C denote nodes for vibration in the optimal flexional vibration resonance mode 26. An ultrasonic wave is irradiated in a fluid in a direction indicated by arrows 28. More specifically, for the ultrasonic underwater sensor 15, the shape of the vibrator 22A is determined by the finite element method, and the vibrator 22A is actually manufactured on an experimental base to confirm that the flexional vibration amplitude at the center of the truncated cone 25 is the maximum at a target frequency (carrier frequency+ frequency modulated by speech) in the optimal flexional vibration resonance mode 26.

For the ultrasonic underwater sensor 15, the vibrator 22A need only be supported practically at the nodes 27A and 27B by the holding means. In this embodiment, however, a recess is formed in the node 27B, and the vibrator 22A is attached to the cover 23 by an O-ring 29, which is fitted into the recess.

In the ultrasonic underwater sensor 15, the vibrator 22A has the truncated cone 25 with an apex at a 90 degree angle and that is as thick as the cylinder 24 as can be inferred from the flexional vibration of a disk. There are few variables, and as the measured values match well the simulation by the finite element method as follows, an ultrasonic underwater sensor that has excellent sensitivity can be acquired.

More specifically, for the ultrasonic underwater sensor 15, if the vibrator 22A is made of SUS316, the thicknesses of the truncated cone 25 and the cylinder 24 are 4 mm, the external diameter of the truncated cone 25 is 32 mm, the length of the cylinder 24 is 13 mm, and the diameter and the thickness of the piezoelectric element 21 are 10 mm and 0.5 mm, respectively. A resonance frequency acquired by the finite element method was 33.5 KHz and the measured value on an experimental basis was 34.5 KHz. The wave transmission and reception sensitivity of the ultrasonic underwater sensor 15 was about −50 dB at 1 m below the water surface.

The received wave detector for the ultrasonic underwater sensor 15 that increases the transmitted wave sensitivity will now be described.

Figure 3:
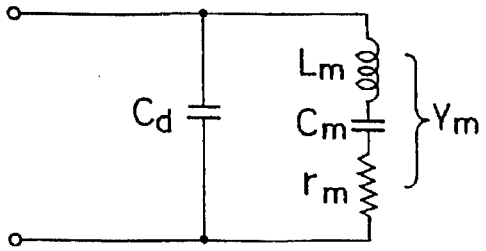
FIG. 3 is an equivalent circuit diagram for a vibrator of the present invention.

In FIG. 3 is shown an equivalent circuit for the vibrator 22A in the ultrasonic underwater sensor 15.

In FIG. 3, Cd denotes a vibrator damping capacitance, Lm denotes a vibrator equivalent inductance, Cm denotes a vibrator equivalent capacitance, and rm is a vibrator equivalent resistance. When a vibrator equivalent mass is M, a vibrator equivalent stiffness is S, a vibrator equivalent mechanical resistance is $R_M$, and a force factor of the vibrator 22A is A, then Lm, Cm and rm are acquired by the following expressions.

$$Lm=M/A^2,\ Cm=A^2/S,\ \text{and}\ rm=R_M/A^2.$$

The damping capacitance Cd of the vibrator 22A is proportional to the surface area of the piezoelectric element 21 and inversely proportional to its thickness. Therefore, when a thin plate, such as the piezoelectric element 21 for flexional vibration of the present invention, is employed, Cd becomes a large capacity. Since the reception voltage is inversely proportional to Cd, as the Cd is increased, the reception sensitivity is lowered.

Figure 4:
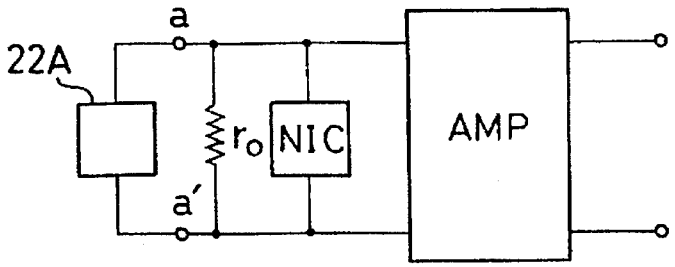
FIG. 4 is a diagram illustrating a received wave detector of the present invention.

In this embodiment, as is shown in FIG. 4, an NIC (Negative Immitance converter) for removing the damping capacitance Cd of the vibrator 22A is attached to the vibrator 22A to prevent a reduction in the reception sensitivity. FIG. 4 is a circuit diagram showing a received wave detector, wherein an NIC is inserted between the vibrator 22A and a proceeding signal amplifier AMP, which amplifies the output of the vibrator 22A. The received wave detector utilizes negative admittance, which is generated by adjusting an equivalent parallel resistance or an equivalent parallel capacity of the NIC load circuit, so that, among a damping impedance and load admittances of the vibrator 22A, the sum of load admittances except for an NIC admittance, i.e., admittance elements that are barriers for damping of the vibrator 22A, are offset. In FIG. 4, $r_o$ is a resistor.

Figure 5:
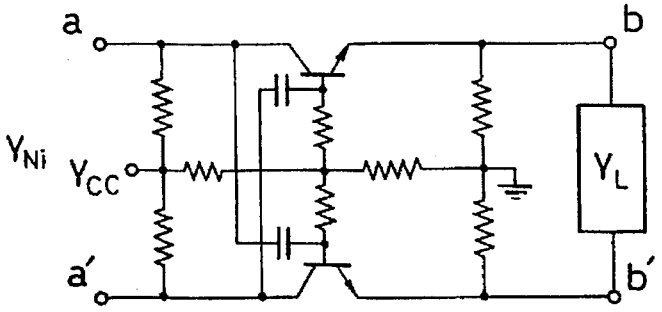
FIG. 5 is a circuit diagram illustrating an NIC example.

FIG. 5 is a circuit diagram showing an NIC example. When an input admittance of the NIC viewed from terminals a–a' is $Y_N i$ and an admittance connected to terminals b–b' is $Y_L$, the relationship between $Y_N i$ and $Y_L$ is represented by the following expression.

$$Y_N i = -KY_L \quad (1)$$

wherein K is a positive constant that is determined by the NIC circuit constant.

According to the circuit structure, the NIC is roughly sorted by s: an open stable NIC and a short-circuited stable NIC. The illustrated NIC is the latter type.

The damping effect at the time of reception of the thus arranged ultrasonic underwater sensor 15 will now be described.

Figure 6:
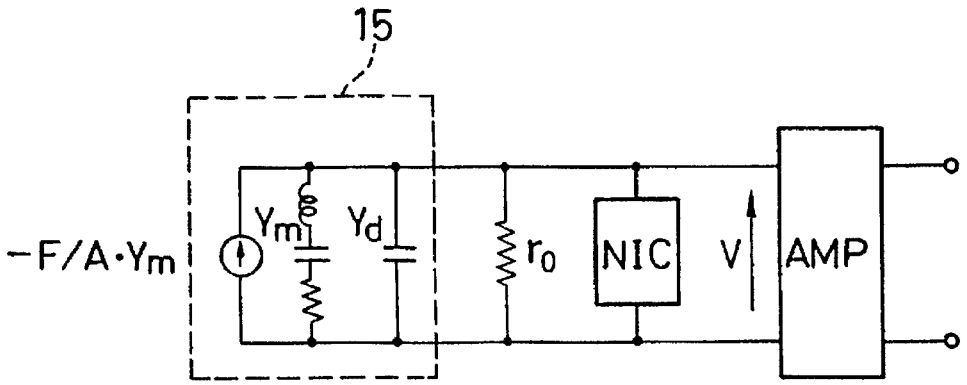
FIG. 6 is a block diagram illustrating an operation model at the time of reception by a receiver.

FIG. 6 shows an operational model at the time of reception for the ultrasonic underwater sensor 15. In this model, the basic expression for electromechanical conversion is represented as follows:

$$F = -AV + A^2/Ym \cdot \dot{v}$$

$$I = (Yo + Yd)V + A \cdot \dot{v} \quad (2),$$

wherein

F: mechanical input force

V: reception voltage

Ym: 1/Zm, motionat admittance of vibrator 22A $\dot{v}$: vibration velocity

I: vibrator current

Yo: admittance when viewing the fight side from terminals a–a' in FIG. 4

Yd: damping admittance of vibrator 22A.

With I=0 in expression (2), the reception output V of the ultrasonic underwater sensor 15 is represented by expression (3):

$$V = -(F/A) \cdot Ym/(Ym + Yo + Yd) \quad (3).$$

In FIG. 6, the portion enclosed by the dotted lines is the equivalent circuit of the vibrator 22A, and V is an output voltage of the ultrasonic underwater sensor 15.

To discuss the response of an output voltage at the time of reception, a Laplace transform is performed to acquire the voltage V based on FIG. 6, and expression (4) is provided.

$$V(s) = \frac{-(F(s)/A) \cdot Ym(s)}{Ym(s) + Yo(s) + Yd(s)} \quad (4)$$

When the admittance of Yo in FIG. 6 is Y'o(s), Yo is obtained by expression (5) using Y'o (s) and the admittance $Y_N i$ of the NIC, and expression (4) is therefore rewritten as expression (6):

$$Yo(s) = Y'o(s) + Y_N i(s) \quad (5)$$

$$V(s) = \frac{-(F(s)/A) \cdot Ym(s)}{Ym(s) + Y'o(s) + Y_N i(s) + Yd(s)} \quad (6)$$

When the relationship represented by expression (7) is satisfied by expression (6), expression (6) is rewritten as expression (8):

$$Y'o(s) + Y_N i(s) + Yd(s) = 0 \quad (7)$$

$$V(s) = -F(s)/A \quad (8).$$

The following expression (9) represents a ratio of wave reception sensitivity, which is obtained by using the method of the present invention, to wave reception sensitivity according to a conventional method.

$$G = 1 + |(Yo + Yd)/Ym| \quad (9).$$

The output voltage, i.e., the reception output response of the ultrasonic underwater sensor 15, to the mechanical input signal is entirely satisfactory, and the wave reception sensitivity can also be enhanced.

The condition that satisfies expression (7) will now be explained. Supposing that $Y_L$ (see FIG. 5) in expression (1) is a parallel admittance of $R_L$ and $C_L$, when relationships represented in expressions (10) and (11) are established, the condition for expression (7) is established:

$$Vo = R_L/K \quad (10)$$

$$Cd = KC_L \quad (11).$$

When the above condition is established, output V(t) is determined by expression (12) by performing an inverse Laplace transform of expression (8):

$$V(t) = -F(t)/A \quad (12).$$

Figure 7A:
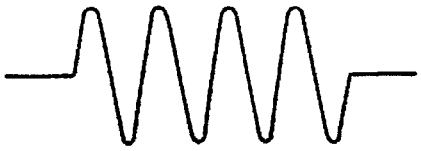
FIG. 7A is a diagram showing the waveform of an input signal of an ultrasonic underwater transducer.
Figure 7B:
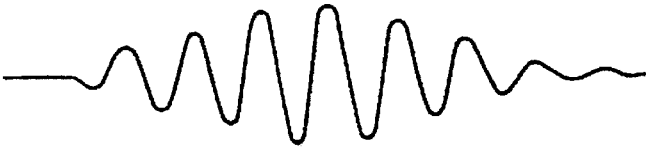
FIG. 7B is a diagram showing the reception output waveform by using a conventional method.
Figure 7C:
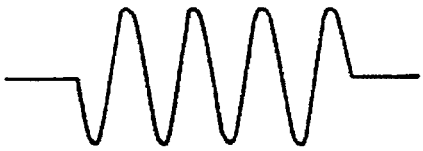
FIG. 7C is a diagram showing a reception output waveform by using the method of the present invention.

FIG. 7A is a diagram showing the waveform of an input signal F(t) of the ultrasonic underwater sensor 15; FIG. 7B is a diagram showing a reception output waveform by using a conventional method; and FIG. 7C is a diagram showing a reception output waveform by using the method of the present invention.

As is apparent from each diagram, according to the present invention, the excessive response characteristic can be absolutely improved.

The function of this embodiment will now be explained.

(1) Since the case 22 for the piezoelectric element 21 is constituted in its entirety by an elastic unit that is resonant in a flexional vibration mode, an ultrasonic resonance frequency (carrier frequency+frequency modulated by speech) can be tuned by adjusting the thicknesses and the diameters at the bottom and at the top of the truncated cone 25 and the height and the internal and external diameters of the cylinder 24, to provide a compact and light sensor.

(2) Since the piezoelectric element 21 is formed of a plate that is thin when compared with the thickness of the truncated cone 25, it is strong and resists the impact of physical abuses.

When the case 22 is made of metal, such as SUS, or plastic (engineering plastic), it is not be deformed by impact when it is dropped, etc., and it satisfactorily protects the piezoelectric element 21, so that the piezoelectric element 21 is highly resistant to damage from abuse.

(3) Since the piezoelectric element 21 is made of a thin and simple plate, the cost is low.

(4) Since the entire vibrator 22A is resonant in the flexional vibration mode, the vibration of the cylinder 24 can increase the vibration of the truncated cone 25 (which has a face for transmitting and receiving a wave). The means for holding the vibrator 22A supports a vibration node 27B (a portion that is not vibrated) of the vibrator 22A, and loss due to vibration friction does not occur at this supported portion. Therefore, the sensor 15 functions at high efficiency and a reduced power consumption.

(5) The shape of the vibrator 22A is acquired by the finite element method, and the vibrator 22A is actually produced to confirm that the optimal flexional vibration resonance mode is a mode in which the flexional vibration at the center of the truncated cone 25 (its wave transmitting-receiving face) of the vibrator 22A is a maximum amplitude at the resonance frequency. At this time, the vibrator 22A has the truncated cone 25 that has an apex at an angle of 90 degrees and that is as thick as the cylinder 24 which can be inferred from the flexional vibration of a disk. As there are few variables, and as actually measured values match well the simulation by the finite element method, an ultrasonic underwater sensor with excellent sensitivity can be easily obtained.

(6) The reduction in wave reception sensitivity, which is caused by the damping capacitance of the vibrator 22A with a thin plate piezoelectric element 21, can be prevented by connecting the NIC (Negative Immitance Converter) to the vibrator 22A.

The detailed effect obtained in the embodiment will now be described.

When the vibrator 22A with its diameter of 32 mm is employed in the ultrasonic underwater sensor 15 at an ultrasonic resonance frequency of 33 KHz, the weight ratio to the conventional thickness vibration mode ultrasonic underwater sensor 30 (FIG. 8) was ⅛ and the volume ratio to it was 1/10. The piezoelectric element of the ultrasonic underwater sensor 15 was 1/30 of cost of the conventional radial vibration mode ultrasonic underwater sensor 40 (FIG. 9), and produces a substantially strong arrangement to resist physical abuse.

When the NIC (Negative Immitance Converter) was installed in the vibrator 22A of the ultrasonic underwater sensor 15 (FIG. 4), the wave transmission and reception sensitivity at 1 m under the water surface was about −10 dB. There is an approximately 40 dB difference in the sensitivity between when the NIC is connected and when it is not connected.

As the result of the employment of the ultrasonic underwater sensor 15 for a SSB type underwater communication device for speech between divers, it was found that the practical use of it for 10 hours or longer was possible for maximum speech distance of 1 km, by using a single alkaline battery of 9 V and with a duty ratio of 10%.

As is described above, according to the present invention, a portable ultrasonic underwater sensor that is highly efficient, compact and light, and sturdy can be provided at a low cost.

While the preferred embodiments of the invention have been described in detail with reference to the drawings, they are by no means limiting, and it should be understood that various changes and modifications are possible without departing from the scope and spirit of the invention, which is set out in the following claims.

What is claimed is:

1. A portable ultrasonic underwater sensor, comprising a piezoelectric element that is stored in a case which is constructed as a cylinder with a right truncated cone integrally and coaxially formed so as to constitute a vibrator, said right truncated cone being axisymmetrical with an apex at a 90 degree angle, said vibrator being formed so that a thickness of said truncated cone is equal to a thickness of said cylinder, said piezoelectric element and said vibrator being bonded together with the center of said piezoelectric element aligned with the center of a reverse face of said right truncated cone of said vibrator, said vibrator being entirely resonant in a vibration mode in which flexional vibration at said center of said truncated cone is a maximum amplitude;

and means for holding said vibrator said means disposed along a vibration nodal line on an external side face of said vibrator.

2. The portable ultrasonic underwater sensor according to claim 1, further comprising an NIC (Negative Immitance Converter) for removing the damping capacitance of said vibrator connected to said vibrator.

* * * * *